US006839945B1

(12) United States Patent
Irwin et al.

(10) Patent No.: US 6,839,945 B1
(45) Date of Patent: Jan. 11, 2005

(54) MOISTURE BARRIER FABRIC AND METHODS OF MAKING SAME

(75) Inventors: Jeffrey D. Irwin, Elkin, NC (US); Christopher M. Harmon, Elkin, NC (US); Steven D. Daniels, Jonesville, NC (US)

(73) Assignee: Chatham, Inc., Elkin, NC (US)

( * ) Notice: Subject to any disclaimer, the term of this patent is extended or adjusted under 35 U.S.C. 154(b) by 0 days.

(21) Appl. No.: 09/800,368

(22) Filed: Mar. 6, 2001

(51) Int. Cl.[7] ..... D04H 1/46; D06N 3/14; D06M 11/76; D06M 15/564; D06M 15/576

(52) U.S. Cl. ..... 28/107; 28/112; 28/115; 28/169; 8/115.51; 8/115.6; 8/125; 8/115.56; 8/115.62; 8/115.65

(58) Field of Search ..... 28/107, 112, 115, 28/169; 8/115.51, 115.6, 125, 115.56, 115.62, 115.65

(56) References Cited

U.S. PATENT DOCUMENTS

| | | | | | |
|---|---|---|---|---|---|
| 2,991,536 | A | * | 7/1961 | Moler | 28/72.2 |
| 3,208,875 | A | | 1/1962 | Holden | |
| 3,843,563 | A | | 10/1974 | Davis et al. | |
| 4,309,800 | A | * | 1/1982 | Foster | 28/115 |
| 5,747,392 | A | | 5/1998 | Xiao et al. | |
| 5,792,715 | A | * | 8/1998 | Duval et al. | 442/328 |
| 6,169,043 | B1 | | 1/2001 | Li | |

FOREIGN PATENT DOCUMENTS

| | | | | |
|---|---|---|---|---|
| EP | 0 445 394 A2 | | 9/1991 | |
| EP | WO 02/070810 | * | 9/2002 | D06C/29/00 |
| WO | WO 99/42284 | | 8/1999 | |
| WO | WO 99/50062 | | 10/1999 | |

OTHER PUBLICATIONS

PCT/US02/00646 International Search Report Mailed Jul. 11, 2003.

* cited by examiner

*Primary Examiner*—Brian P. Mruk
(74) *Attorney, Agent, or Firm*—Kilpatrick Stockton LLP; Bruce D. Gray

(57) ABSTRACT

The invention relates to a method for preparing a moisture barrier fabric comprising needing the fabric in a direction substantially opposite to the advance direction of the fabric with barbed needles to increase the density of the fabric by entangling the fibers thereof, open-width washing of the needled facecloth fabric with a detergent and sodium carbonate to further increase fabric density by allowing the fabric to neck down or bulk at a substantially random rate, coating one side of the fabric with at least one coating of a latex formulation for use in forming the backcoating of the moisture barrier fabric, comprising a (meth)acrylic acid urethane copolymer having a curing temperature of approximately 250 to 275° F., and immersing the dry moisture barrier fabric, including the latex backing, into a bath of fluorochemical and solution containing about 10 to about 15 wt % polyurethane, and removing excess fluorochemical from the treated fabric.

36 Claims, 2 Drawing Sheets

MOISTURE BARRIER FABRIC AND METHODS OF MAKING SAME

BACKGROUND OF THE INVENTION

1. Field of the Invention

This invention relates to moisture barrier fabrics and to methods for making them. The fabrics are suitable, e.g., as upholstery fabrics.

2. Description of Related Art

The need for fabric materials that are impervious, or at least resistant, to moisture has long been recognized in the upholstery industry. The desirability of preventing the penetration of liquids into household furniture is apparent to anyone with small children. Penetration of moisture into the interior of furniture can result in odors and decay of the internal parts of the furniture. In addition, fabrics for use in outdoor furniture are also desirably moisture resistant, since these fabrics are frequently exposed to the elements. Window treatment fabrics, by virtue of their placement near windows and doors, are often exposed to moisture as well.

Moisture barrier fabrics that are composite materials having a fabric "face cloth" and a latex backing layer are known in the art. The latex is typically applied in one or more coats, using a doctor blade or other device for applying a thin coating. Prior to application of the latex coating, however, composite moisture barrier fabrics have generally required treatment with a primer to prepare the fabric surface to receive the backing. This ensures good bonding between the fabric and the backing, and reduces the risk of delamination or separation. However, use of a primer requires an additional coating step and the requisite coating process equipment and the application of additional chemicals to the fabric.

Many of the latices used as fabric coatings have relatively high curing temperatures. This limits the type of fabric that can be used in making the face cloth to those that have melting points well above the curing temperature of the latex. Often, a latex is used that has a curing temperature in excess of 300° F., which would turn a woven polypropylene fabric into a puddle of resin. This effectively removes polypropylene from consideration as a possible facecloth material.

Typically, the face cloth materials of the moisture barrier fabrics are treated with fluorochemicals to increase oil and water repellency. This treatment generally includes applying the fluorochemicals, e.g., by spraying or other methods, to the face cloth prior to assembly into the composite, or during application of the backing layer to form the composite. However, such application does not provide a complete coating of the backing layer, or even provide complete coverage of the face cloth, and small openings through which moisture can penetrate the fabric remain. In addition, subsequent processing of the fabric can damage the repellent coating.

Many moisture barrier fabrics have poor tactile qualities, and do not have a pleasant "hand." Since these fabrics are often used as upholstery fabrics for interior use where the consumer will often touch the fabric, the heretofore necessary trade-off between moisture barrier performance and the feel of the fabric to the touch has resulted in some consumer dissatisfaction.

There remains a need in the art for a moisture barrier fabric that can be prepared using low coating/curing temperatures, that has improved repellency, that has good hand without sacrificing moisture barrier performance, and that does not require the use of a primer for good results.

SUMMARY OF THE INVENTION

In one embodiment, the invention relates to a method for preparing woven face cloth for back coating with a latex, comprising needling the fabric in a direction substantially opposite to the advance direction of the fabric to increase the density of the fabric by entangling the fibers thereof.

In another embodiment, the invention relates to a method for open-width washing of the facecloth fabric with a detergent and sodium carbonate to further increase fabric density by allowing the fabric to neck down or bulk at a substantially random rate.

In yet another embodiment, the invention relates to a latex formulation for use in forming the backcoating of the moisture barrier fabric, comprising a (meth)acrylic acid urethane copolymer having a curing temperature of approximately 250 to 275° F.

In yet embodiment, the invention relates to a method of applying fluorochemical to a moisture barrier fabric by immersing the dry moisture barrier fabric, including the latex backing, into a bath of fluorochemical, and removing excess fluorochemical from the treated fabric.

In yet another embodiment, the invention relates to a method of improving the hand of the fabric by treating the fabric with a solution containing about 10 to about 15 wt % polyurethane.

In yet another embodiment, the invention relates to a method for preparing a moisture barrier fabric comprising needling the fabric in a direction substantially opposite to the advance direction of the fabric with barbed needles to increase the density of the fabric by entangling the fibers thereof, open-width washing of the needled facecloth fabric with a detergent and sodium carbonate to further increase fabric density by allowing the fabric to neck down or bulk at a substantially random rate, coating one side of the fabric with at least one coating of a latex formulation for use in forming the backcoating of the moisture barrier fabric, comprising a (meth)acrylic acid urethane copolymer having a curing temperature of approximately 250 to 275° F., and immersing the dry moisture barrier fabric, including the latex backing, into a bath of fluorochemical and a solution containing about 10 to about 15 wt % polyurethane, and removing excess fluorochemical from the treated fabric.

The invention also relates to the moisture barrier fabric produced by the methods described above.

The invention provides a method for making a moisture barrier fabric that does not require the use of a primer coating to apply the backing layer. It also uses a latex composition that cures at a relatively low temperature, thereby decreasing process energy requirements and increasing the range of fibers that can be used to make the facecloth fabric. The application of fluorochemical to the entire composite, instead of just one surface of the facecloth fabric, encapsulates the composite with water and oil repellent, and tends to close small openings in the composite that might otherwise admit moisture. Finally, the application of polyurethane to the fabric gives it a softer, more pleasant hand, rendering the fabric more desirable to consumers.

The invention will be described in more detail below by reference to the drawing figures, and to specific embodiments thereof, which are intended to be illustrative only, and not to limit the scope of the invention in any way.

DETAILED DESCRIPTION OF SPECIFIC EMBODIMENTS

Figure 1:
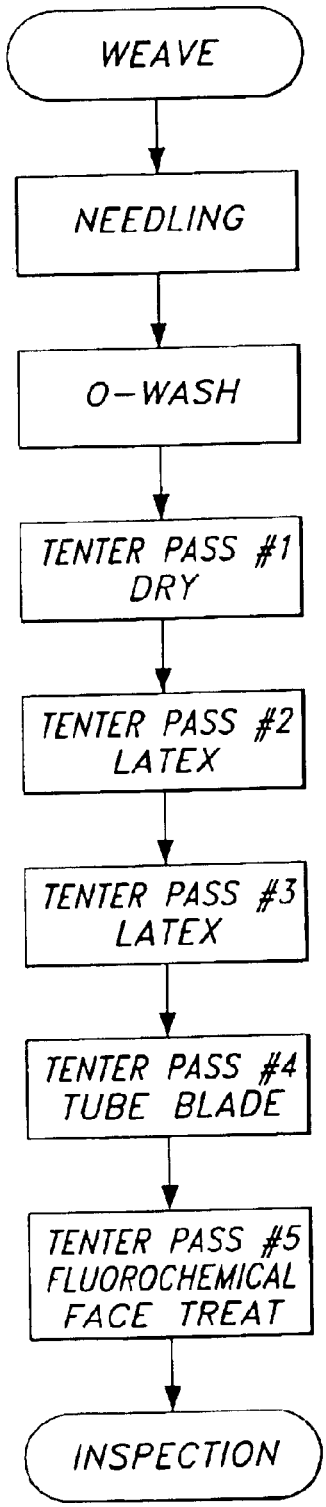
FIG. 1 is a schematic block diagram showing the process steps of one embodiment of the invention.
Figure 2A:
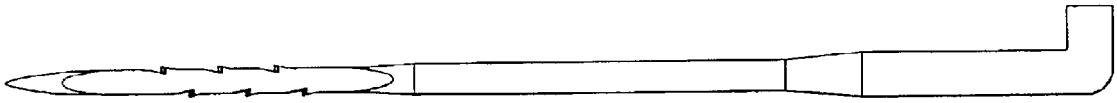
FIG. 2 shows a schematic view (FIG. 2A) and longitudinal cross sectional views (FIG. 2B) of a needle used in the needling process of one embodiment of the invention.
Figure 2B:
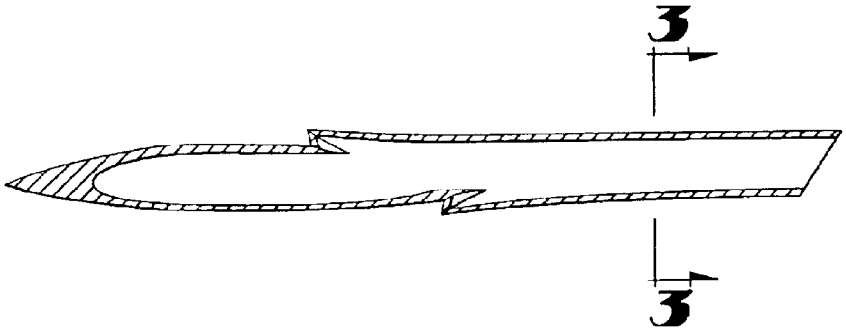
Figure 3:
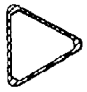
FIG. 3 shows a transverse cross sectional view of a needle used in the needling process of one embodiment of the invention.

As shown in FIG. 1, woven fabric is subjected to a needling step in order to entangle the fibers of the fabric, thereby decreasing the necessity for the application of a primer prior to application of the latex backcoating. Needling is done using, e.g., the Foster needles shown in FIG. 2. The leading edge of the needle is barbless, and penetrates the fibers against the direction of fabric flow. This penetration itself causes little fiber entanglement. However, the needles, which may have a triangular transverse cross section, have one or more barbs located at various distances from the tip (e.g., the needle in FIG. 2 has barbs at 8.5 mm from the tip and 6.4 mm from the tip). The orientation of the barbs may vary, but barbs that point in the direction of the leading edge of the needle, as shown in FIG. 2, have been found to be satisfactory. The barb angle of the barbs may vary substantially; a 20° barb angle has been found to be satisfactory. Similarly, the depth and shape of the barbs may vary; barbs that are 0.0048 inches deep, with a kick up, have been found to be satisfactory. The barbs on the lagging edges of the needle also penetrate the fibers against the direction of fabric flow, but cause entanglement of the fibers.

While the processing rate of the needling step is necessarily somewhat variable, it has been found that processing at 20 yds/min gives satisfactory results. Needling is generally done to a depth of 7.5 in. at 1150 RPM. The needles may be staggered (i.e., horizontally offset) to achieve maximum penetration. Varying process parameters slightly can cause the needling to occur in a substantially random pattern. Needle penetrations are approximately 300 to about 400 penetrations per square inch, more particularly about 370 penetrations per square inch.

In another embodiment of the invention, the facecloth fabric (desirably after having undergone the needling step described above) undergoes open-width washing to further increase the density of the fabric. The fabric is contacted with a solution of detergent, desirably a nonionic detergent, and sodium carbonate at a temperature of around 120° F. This solution typically contains nonionic detergent in concentrations ranging from about 0.05 to about 1.00 g/L, more particularly about 0.25 g/L. Sodium carbonate is generally present in concentrations ranging from about 0.75 g/L to about 1.5 g/L, more particularly about 1.25 g/L. Washing can be done in an open width continuous washer, e.g., incorporating a soaping vat and one or more rinsing chambers. While the processing speed can vary, satisfactory results have been obtained using a processing speed of 40 yds/min.

As described above, the latex used to form the backcoating of the moisture barrier fabric of the invention is one that requires a low curing temperature, typically around 250° F. to around 275° F. Desirably, the latex will have a minimum viscosity of at least about 20,000 cp to about 30,000 cp at about 25° C., more particularly a minimum viscosity of about 50,000 to about 60,000 cp at about 25° C. Suitable latices generally include blends of acrylic and polyurethane polymers, such as PERFORMAX 3569A (acrylic-polyurethane latex emulsion, BF Goodrich).

The backcoating can applied using a series of tenter passes, although other techniques known in the art for applying coatings to fabrics can also be used. For example, the fabric can undergo one or more tenter passes wherein an acrylic-polyurethane copolymer is applied by a thin blade applicator at a temperature of around 275° F. and a dwell time of around 15 seconds. The latex copolymer may have incorporated therein an antimicrobial, such as INTERSEPT antimicrobial (Interface, Inc.). Additional tenter passes that are either dry (but at an elevated temperature of, e.g., around 250° F.) or using a tube blade (for a rounded edge application) may also be used.

After the backcoating has been applied, the fabric, including the backcoating, is submerged in a bath containing the fluorochemical. In a specific embodiment, the bath contains an aqueous solution of about 10 to about 15 wt % of a nonionic fluorochemical. One example of a suitable nonionic fluorochemical is FCl367 (fluoroaliphatic polymer composition, 3M).

The bath can also contain one or more stainblockers (such as, e.g., around 10 wt % of a stainblocker, such as a methylacrylic acid-based stain blocker, in particular, an anionic MAA based stainblocker, known in the art and marketed by companies such as 3M as FC672), wetting agents (typically non-rewetting wetting agents, such as, e.g., around 0.5 wt % of a wetting agent like Unifroth 0448 (nonionic surfactant, Unichem) are used to increase compatibility with the fluoropolymer).

The fabric may also be treated with a solution of about 10 to about 15 wt % polyurethane, in order to modify the hand of the fabric (i.e., to make it feel softer). The polyurethane can be incorporated into the fluorochemical treatment solution, or applied as a separate step, if desired. Desirably, the polyurethane is ethoxylated in order to increase its emulsifiability, although non-ethoxylated polymers can also be used. An example of a suitable ethoxylated polyurethane is Dicrylan BSRN (urethane emulsion, CIBA).

The fluorochemical and/or polyurethane is applied in the bath at a rate of about 10 to about 70 % wet pick up, and a liquor to goods ratio of about 150:1. The application temperature is not critical, and the solution may be applied at ambient temperature. Dwell time in the bath can range from about 1 to about 5 seconds. Any excess treatment liquid is removed from the fabric, e.g., by passing the fabric through nip rollers at a nip pressure of about 20 to about 40 psi. The treatment mixture is then allowed to cure at a temperature of about 225 to about 300° F.

The invention has been described above with respect to its specific embodiments. This description is not intended to limit the literal scope of the appended claims or of the range of equivalents to which the claims are entitled.

What is claimed is:

1. A method for preparing a moisture barrier fabric, comprising:

needling a woven fabric with a needle having at least one barb sufficient to entangle the fibers of the woven fabric; and applying at least one coating of an aqueous latex emulsion to at least one side of the needled woven fabric.

2. The method of claim 1, wherein the needling is in a direction substantially opposite an advancing direction of the fabric.

3. The method of claim 2, wherein the barbs are oriented generally in the direction of needling, and penetrate the fabric in a direction substantially opposite the advancing direction of the fabric.

4. The method of claim 3, wherein the needle comprises at least one barb having a barb angle of about 20°.

5. The method of claim 1, wherein the needling comprises piercing the fabric with multiple needles arranged in a staggered arrangement.

6. The method of claim 1, further comprising:

contacting the woven fabric with a washing solution comprising:
a detergent; and
sodium carbonate.

7. The method of claim 6, wherein the detergent is nonionic.

8. The method of claim 6, wherein the contacting occurs at a temperature of about 120° F.

9. The method of claim 6, wherein the contacting occurs in a soaping vat, and further comprising rinsing the fabric in water or an aqueous solution in one or more rinsing chambers.

10. The method of claim 7, wherein the nonionic detergent is present in a concentration ranging from about 0.05 to about 1.00 g/L of the washing liquid.

11. The method of claim 10, wherein the nonionic detergent is present in a concentration of about 0.25 g/L of the washing liquid.

12. The method of claim 6, wherein the sodium carbonate is present in a concentration ranging from about 0.75 g/L to about 1.5 g/L of the washing liquid.

13. The method of claim 12, wherein the sodium carbonate is present in a concentration of about 1.25 g/L of the washing liquid.

14. The method of claim 1, wherein the aqueous latex emulsion comprises a blend of acrylic and polyurethane polymers having a curing temperature ranging from about 250° F. to about 275° F.

15. The method of claim 14, further comprising curing the acrylic-polyurethane copolymer.

16. The method of claim 14, wherein at least two coatings of latex emulsion are applied to the woven fabric.

17. The method of claim 14, wherein the latex emulsion has a viscosity of at least 20,000 cp.

18. The method of claim 17, wherein the latex emulsion has a viscosity of at least 30,000 cp.

19. The method of claim 18, wherein the latex emulsion has a viscosity of at least 40,000 cp.

20. The method of claim 19, wherein the latex emulsion has a viscosity of at least 50,000 cp.

21. The method of claim 20, wherein the latex emulsion has a viscosity of at least 60,000 cp.

22. The method of claim 1, further comprising:

immersing the woven fabric and latex coating in a treatment solution comprising a fluorochemical.

23. The method of claim 22, wherein the treatment solution further comprises a stainblocker.

24. The method of claim 22, wherein the treatment solution further comprises a wetting agent.

25. The method of claim 22, wherein the treatment solution further comprises a polyurethane.

26. The method of claim 22, wherein the fluorochemical is present in the treatment solution in an amount ranging from about 10 wt % to about 15 wt % based on the total treatment solution.

27. The method of claim 25, wherein the polyurethane is present in the treatment solution in an amount ranging from about 10 wt % to about 15 wt % based on the total treatment solution.

28. The method of claim 22, wherein the fluorochemical is nonionic.

29. The method of claim 23, wherein the stainblocker is anionic.

30. The method of claim 23, wherein the stainblocker comprises a polymer of (meth)acrylic acid.

31. The method of claim 24, wherein the wetting agent is a non-rewetting wetting agent.

32. The method of claim 1, further comprising:

immersing the woven fabric and latex coating in a treatment liquid comprising a polyurethane.

33. The method of claim 32, wherein the polyurethane is present in the treatment liquid in an amount ranging from about 10 wt % to about 15 wt % based on the total treatment solution.

34. The method of claim 32, wherein the polyurethane is present as an emulsion.

35. The method of claim 32, wherein the polyurethane is ethoxylated.

36. A method for preparing a moisture barrier fabric, comprising:

needling a woven fabric with a needle having at least one barb sufficient to entangle the fibers of the woven fabric;

contacting the needled woven fabric with a washing solution comprising:
a detergent; and
sodium carbonate;

applying at least one coating to a side of a woven fabric, the coating comprising an aqueous latex emulsion of an acrylic-polyurethane copolymer having a curing temperature ranging from about 250° F. to about 275° F.;

immersing a fabric comprising a woven facecloth and a latex backing in a treatment solution comprising a fluorochemical and a polyurethane.

* * * * *